US007174682B2

(12) United States Patent
Pelosi, Jr.

(10) Patent No.: US 7,174,682 B2
(45) Date of Patent: Feb. 13, 2007

(54) TRANSITION SUPPORT FOR FLOORING MATERIAL

(75) Inventor: Frank Pelosi, Jr., Moorestown, NJ (US)

(73) Assignee: Johnsonite Inc., Chagrin Falls, OH (US)

( * ) Notice: Subject to any disclaimer, the term of this patent is extended or adjusted under 35 U.S.C. 154(b) by 1073 days.

(21) Appl. No.: 10/102,445

(22) Filed: Mar. 19, 2002

(65) Prior Publication Data

US 2002/0088067 A1 Jul. 11, 2002

Related U.S. Application Data

(63) Continuation of application No. 08/801,010, filed on Feb. 19, 1997, now Pat. No. 6,385,923.

(51) Int. Cl.
*E04F 11/16* (2006.01)

(52) U.S. Cl. ..... 52/179; 52/174; 52/287.1; 52/717.03; 52/717.05; 16/7; 16/16; 14/69.5; 248/188.3

(58) Field of Classification Search ..... 52/63, 52/181, 179, 273, 287.1, 717.03, 717.05, 52/461, 465, 174; 16/4, 7, 16; 248/615, 248/633, 188.2, 346.05, 188.3; 292/342, 292/343; 14/69.5
See application file for complete search history.

(56) References Cited

U.S. PATENT DOCUMENTS 530,096 A 12/1894 Eckman
1,070,273 A 8/1913 MacLean
1,128,061 A 2/1915 Schroeter
1,401,490 A 12/1921 Rathjens
1,483,941 A 2/1924 Kasson
1,833,732 A 11/1931 Barrows
1,988,603 A 1/1935 McLaren et al.
2,142,832 A 1/1939 Bell
2,677,145 A 5/1954 Adams
3,086,262 A 4/1963 Krantz
4,187,656 A 2/1980 Lutz
4,557,475 A 12/1985 Donovan
5,212,923 A 5/1993 Pelosi et al.
5,243,798 A 9/1993 Elliott
5,475,953 A 12/1995 Greenfield
5,581,967 A * 12/1996 Glatz ..... 52/465
5,657,598 A 8/1997 Wilbs et al.
6,062,517 A * 5/2000 Torres et al. ..... 248/188.2
6,141,931 A * 11/2000 Simmons ..... 52/480
6,230,446 B1 * 5/2001 Chalich ..... 52/98
6,385,923 B1 * 5/2002 Pelosi, Jr. ..... 52/179

* cited by examiner

*Primary Examiner*—Jeanette E. Chapman
*Assistant Examiner*—Yvonne M. Horton
(74) *Attorney, Agent, or Firm*—D. Peter Hochberg; Sean Mellino

(57) ABSTRACT

A transition support for flooring extending between a floor area of a high height and a floor area of a low height, said support being in the shape of a wedge which is generally unnoticeable by persons walking across the support and which does not jostle wheeled vehicles crossing the support.

18 Claims, 3 Drawing Sheets

TRANSITION SUPPORT FOR FLOORING MATERIAL

CROSS-REFERENCES TO RELATED APPLICATIONS

This application claims the benefit of U.S. application Ser. No. 08/801,010, filed Feb. 19, 1997 which issued as U.S. Pat. No. 6,385,923 on May 14, 2002.

BACKGROUND OF THE INVENTION

1. Field of the Invention

This invention relates to supporting flooring at the juncture of materials of different heights, at the transition at the juncture between the materials, where the transition is generally desired to be unnoticeable to people walking on flooring over the juncture or where wheeled vehicles will not be jostled or upset when crossing transition at the juncture.

2. Description of the Prior Art

There is often a juncture in floors made of different materials, since the floor often has areas of different heights. In many institutions, factories, exhibitions halls, shopping malls, transportation facilities and the like, floors of hard materials such as tile, marble, granite, brick, quarry stone or ceramic are frequently adjacent to floors of concrete or wood. The adjacent floors usually meet at a juncture, and there is an interface between the floor area of the relatively high height and the floor area of a relatively low height. Transition flooring is often put over the floor areas to make it easier and safer to walk across the floor areas and the juncture, and to make it easier for wheeled vehicles to traverse the juncture of the floor areas. It is common to ramp up to the higher floor area made of hard materials.

However, the transition flooring, which can be flexible vinyl or rubber based sheet or tiles, or a carpet material, or a hardened resilient material such as vinyl composition or hard rubber tiles, must cross the juncture. If no transition support is provided, there could be a sharp incline in the flooring at the juncture. People could trip or at least be surprised when they step on the flooring at the juncture, especially if they are unaware that the difference in heights exists. In addition, wheeled vehicles could be jostled, tipped or possibly overturned if they reach an unexpected abrupt change in the heights of the flooring. Moreover, the transition flooring could become frayed, cracked or torn over time, especially if the juncture is in an area of high traffic.

In most instances in commercial buildings where the sharp transition between floor materials of different heights is made more gradual, a worker uses a trowel to lay by hand cementious material such as a latex underlayment at the juncture between the high and low flooring levels. This is time consuming and expensive, and the time to lay the material depends on the ability and skill of the troweler. Once the troweler has laid the cementious material, he or she uses adhesive to connect the flooring material to the cementious material. In other cases, workers stack old tile to reduce the steepness of the juncture between the adjacent flooring areas.

The difference in height between the two areas of the floor as discussed above are often not great, often around ¼ inch, so the problem has not been previously and seriously addressed. Architects have no standard for addressing the problem. Compensating for the difference in heights between adjacent flooring areas is a real problem.

There are various patents which have been issued relating to the support of carpets near walls, including U.S. Pat. Nos. 530,096 (Eckman 1894), 1,070,273 (MacLean 1913), 1,401,490 (Rathjens 1921), 1,483,941 (Kasson 1924) 1,833,732 (Barrows 1931), 1,988,603 (McLaren et al. 1935), 2,677,145 (Adams 1954), 3,086,262 (Krantz 1963) and 4,187,656 (Lutz 1980).

However, the foregoing patents are not directed to the support of flooring at the juncture between adjacent floor areas of different heights. U.S. Pat. No. 1,128,061 (Schroeter 1915) is directed to metal edge binding in linoleum, which is also not a problem to which the present invention relates. Rather, Schroeter provides an edge binding which securely holds the floor covering in place and protects the edge of same. Schroeter wants to protect the flooring against, for example, breakage or wear by shoes or truck wheels, but Schroeter is not concerned with people or vehicles crossing the floor. U.S. Pat. No. 5,475,953 (Greenfield 1995) relates to an edge molding strip for protecting the floor covering between first and second floors of different heights, but it relates to the objects of the present invention in only a very general way. U.S. Pat. No. 5,243,798 provides a wedge shaped finishing member for draining water away from a bathtub, and it too is not directed to the problems to which the invention is directed.

U.S. Pat. No. 2,142,832, Bell, discloses a mat construction made of a multiplicity of rubber blocks arranged in an overlapping, laterally abutting relationship. The mat has a nosing strip running along its edge. Bell does not recognize the problem of providing a transition between two levels of flooring.

SUMMARY OF THE INVENTION

It is an object of the present invention to provide a support for flooring covering floor areas of different heights.

Another object of the invention is to provide a support for flooring, such as those having vinyl or rubber components or those made of carpeting, which cover the juncture of flooring areas made of different materials and have different heights.

An additional object is to provide a support for hard flooring, such as hard resilient flooring like vinyl composition or hard rubber tiles, for covering the juncture of flooring areas made of materials having different heights.

A further object of the present invention is to provide a transition support for flexible sheet flooring at the juncture of floors made of ceramic or tile, and floors made of concrete or wood, where there is a difference in heights between the two sections of the floor.

Yet another object of the invention is to provide a transition support for flooring as described above, which is generally unnoticeable to person walking across the support or which does not jostle wheeled vehicles crossing the support.

An object is to provide a transition support for flooring areas of different heights which can be installed by workers who need not be highly skilled in laying transition supports.

A still further object of the invention is to provide a transition support as described above which can be made in large economical quantities, and which can be installed quickly, economically and effectively in large institutional buildings such as schools and hospitals, office buildings, factories, shopping malls and other stores, exhibitions halls transportation facilities and the like.

According to the preferred embodiment of the invention, a transition support (which is also called a patch board or leveler strip) has a wedge shaped construction. It is made of a flexible plastic such as vinyl and has a thick end portion, a parallel thin end portion, and a tapering section which extends from the upper portion of the thick end to the thin end. Alternatively, it can be a hard material such as vinyl composition or hard rubber tiles. (The sections will be described as if the transition support is in place, with an upper section and a lower section). The contour of the tapering section is very slight, so that walkers crossing the transition support, especially when it is covered with a flooring, will not be aware of its presence. Likewise, carts, motor driven carriers, dollies, wheeled stretchers, wheeled carrying cases, and other wheeled vehicles will not be jostled or upset when they cross the transition support for the flooring supported thereby.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
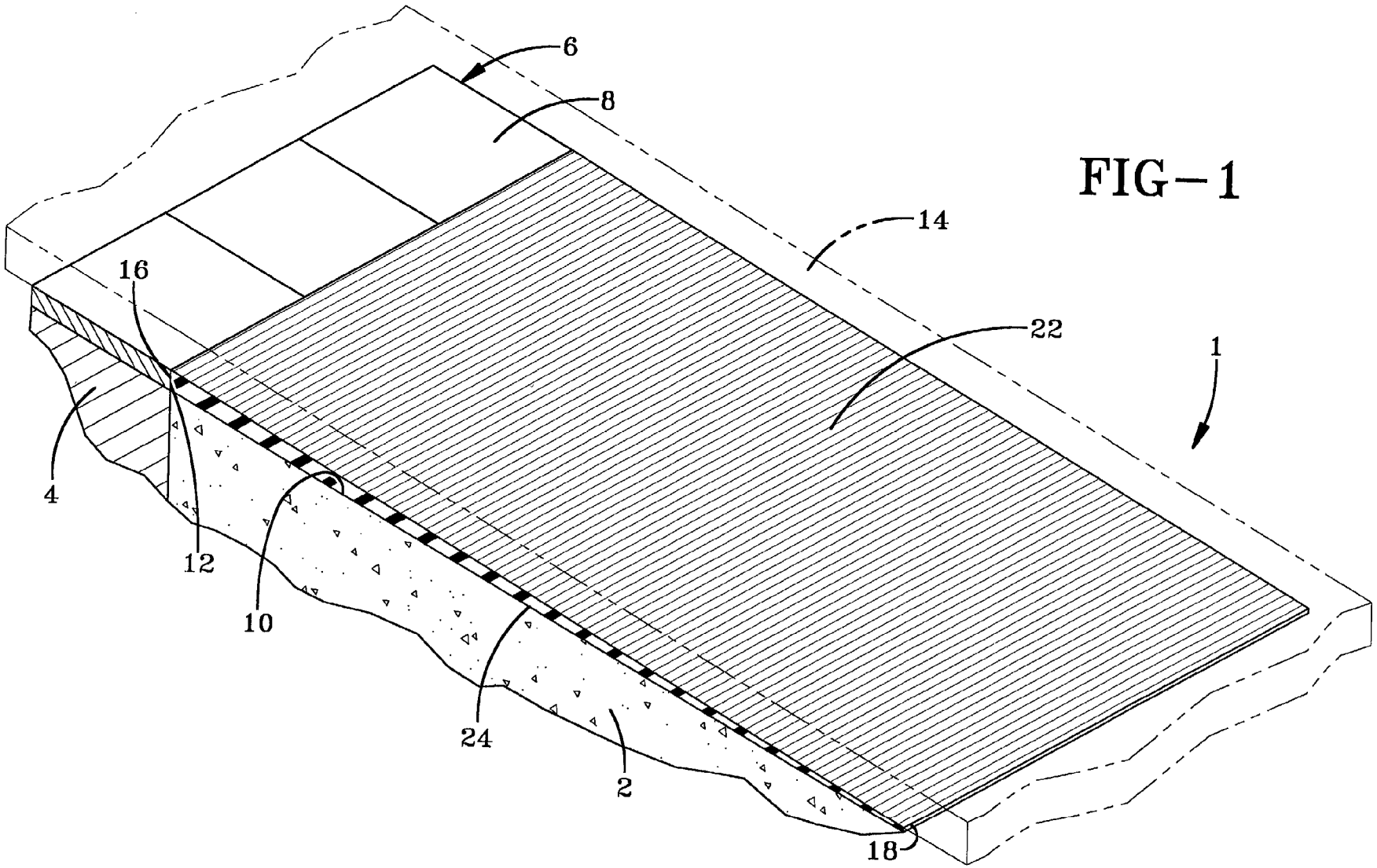
FIG. 1 is a perspective view of the transition support according to the preferred embodiment of the invention, installed for supporting a flexible sheet flooring.

Referring now to the drawings wherein the showings are for the purpose of illustrating the preferred embodiment of the invention only, and not for the purpose of limiting same, FIG. 1 shows a transition support 1 in perspective. It is located on a concrete floor 2 which is adjacent to another floor 4. A set of tiles 6 are located on floor 4. Tiles 6 could be of vinyl, rubber, ceramic or any other composition. Tiles 6 could be replaced by any other type of floor, provided for the present discussion that their top surface 8 is above or below the top surface 10 of floor 2. Tiles 6 are shown above floor 2. A juncture 12 exists between flooring 2, and the flooring 4 and tiles 6.

A flexible sheet flooring 14, shown in phantom lines, lies on floor 2, on transition support 1, and on tiles 6. Flooring 14 could be harder, and less flexible or inflexible. Transition support 1 rests on a floor 2, and support 1 has a thick end 16 and a thin end 18. Thick end 16 is generally equal to the difference in height between the lower floor area (area 2 in the present example), and the higher floor area (area 4 and tile 6 in the present example). For this discussion, the heights of floor 2 and floor 4 are the same (and they could be the same floor), so thick end 16 is shown equal to the thickness tiles 6. The thickness of thick end 16 need not exactly equal the difference in height between the two adjacent floor areas, since support 1 can be flexible and resilient, so the transition between the heights will not be noticeable.

Figure 2:
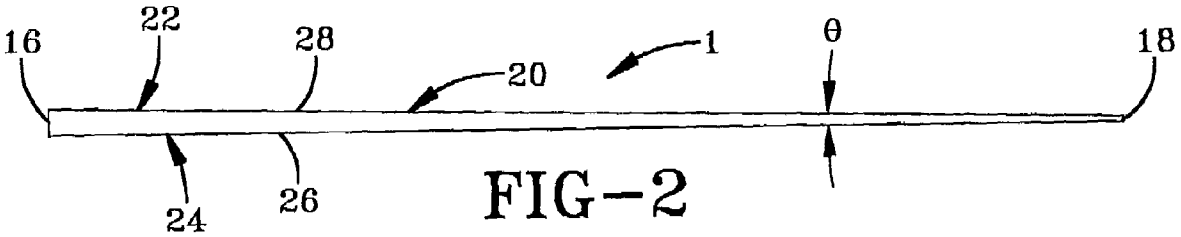
FIG. 2 is a side view of the transition support shown in FIG. 1.
Figure 3:
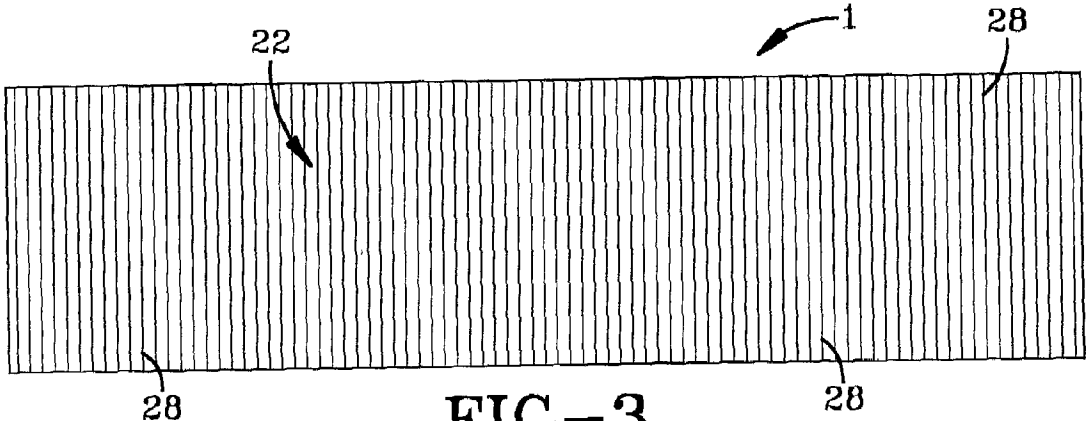
FIG. 3 is a plan view of the transition support shown in FIG. 1.
Figure 4:
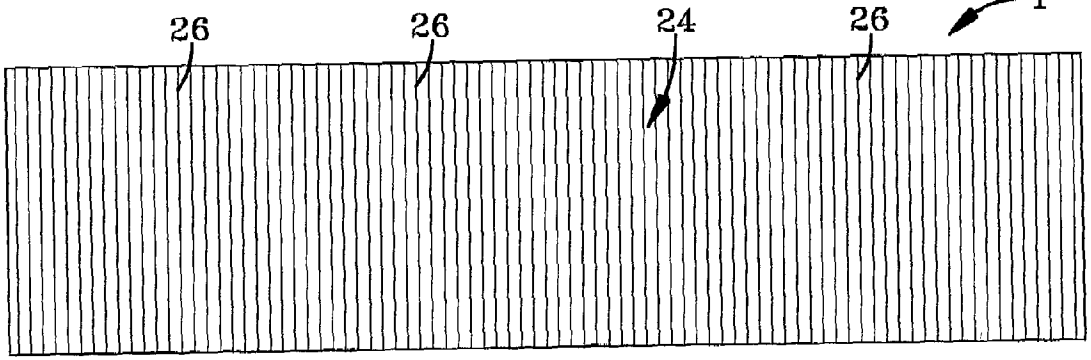
FIG. 4 is a bottom view of the transition support shown in FIG. 1

Transition support 1 has a tapering section 20 extending between thick end 16 and thin end 18. Tapering section 20 has a top surface 22 and a bottom surface 24, as shown in FIGS. 2–4. The tapering surface should be of sufficient distance between thick end 16 and thin end 18 so that one crossing support 1 on foot or with a wheeled vehicle would not notice transition support 1, or the vehicle would not be jostled or upset. The distance between thick end 16 and thin end 18 is at least thirty (30) times the thickness of the thick end. In the preferred embodiment, thick end 16 was ¼ inch thick and thin end 18 was disposed 12 inches from thick end 16, and the interior angle between top surface 22 and bottom surface 24 was 3+. The thickness at the thick end should not exceed 3/16 inches. The maximum angle for other preferred versions of the invention should not exceed 10°, and the minimum angle should be less than 1°. The width, or distance between the thick end 16 and the thin end 18, should generally be between 10 inches and 20 inches. The distance between the thick end and the thin end should be at least 30 times the thickness of the thick end but could, in some instances, have a lower ratio depending on the difference in the heights of the floors.

In order to secure support 1 on a floor such as floor 2, an appropriate adhesive can be used. In order to promote the strength of the adhesive, slight ridges 26 or other physical changes in bottom surface 24 are provided to hold the adhesive as well as to improve the friction between support 1 and the floor. Likewise, ridges 28 are provided on the top surface of support 1. An effective set of ridges has been found to be about 10 ridges per inch and to be less than 0.1 mm in height. Flooring 14 is preferably secured to support 1 with an appropriate adhesive, and ridges 28 both hold the adhesive in place and increase friction between flooring 14 and support 1. The ridges could be replaced with grooves. Other forms of physical variations in surface 22 and 24 are available.

Transition 1 can be flexible sheet flooring prepared in roll form or in long sheets, with the thick and thin end portions being the side surfaces. The appropriate length is cut from the roll, or one or more sheets (or parts of sheets) are selected. The thickness of the thick end 16 should generally equal the difference in height between the two flooring areas. Adhesive is spread in the floor of the lower floor area as far from the juncture as support 1 will extend, on bottom surface 24 of support 1, or in the floor and the bottom surface, and the support 1 is laid in place. Adhesive is then put in top surface 22 of support 1, on the sheet flooring 14, or on both, and flooring 14 is then placed on support 1. The system is ready for use once the adhesive has dried or cured, if necessary.

Figure 5:
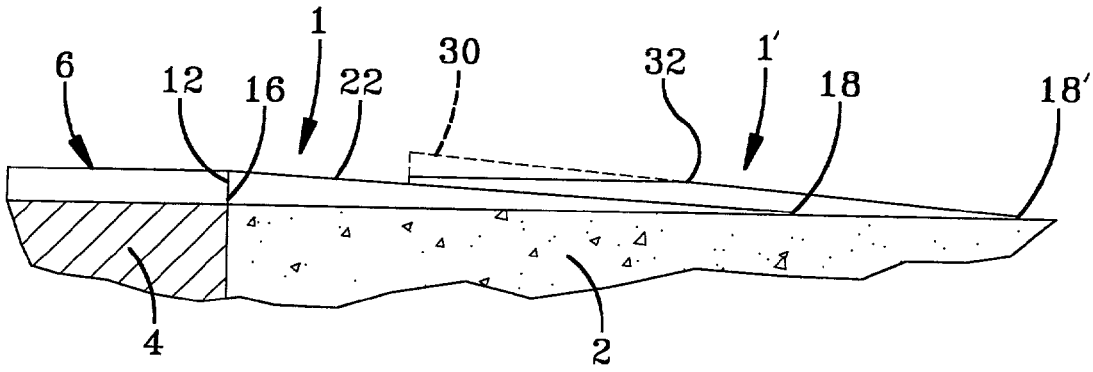
FIG. 5 is a side view of transition supports stacked in tandem
Figure 6:
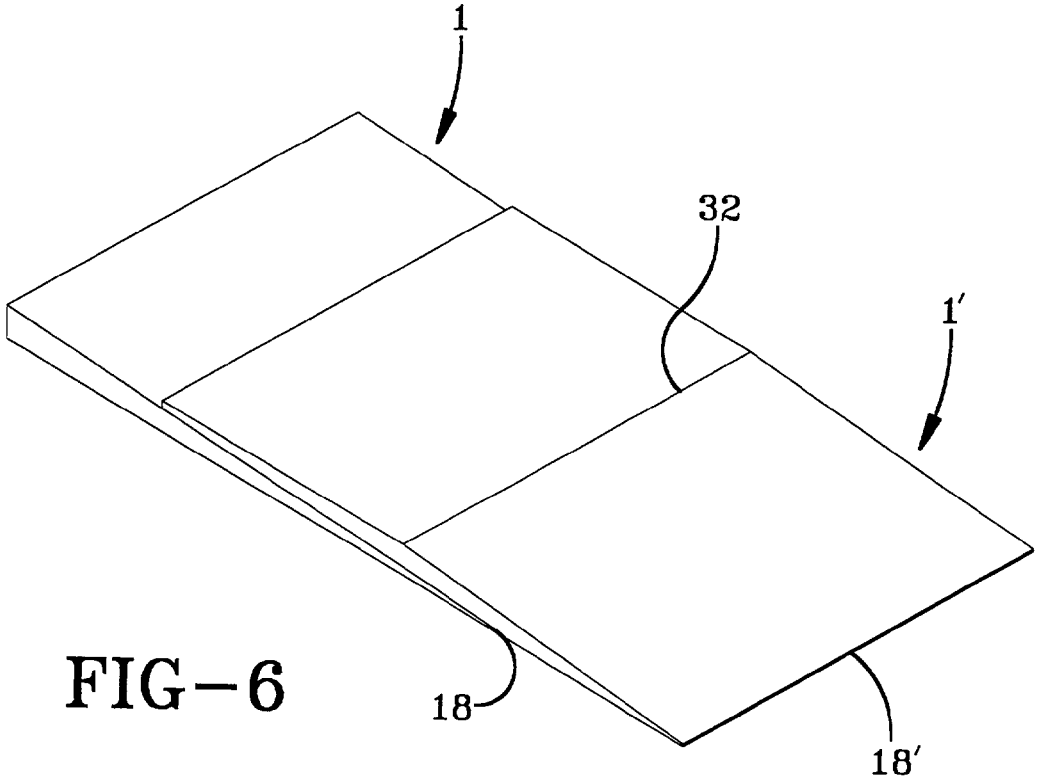
FIG. 6 is a perspective view of the stacked transition supports shown in FIG. 5.

In some situations, it may be necessary to decrease the slope of the tapered section of the transition support, as where the high floor requires a wider transition support. This can be accomplished by stacking transition support 1 in tandem, that is, by stacking them like shingles. Referring to FIG. 5, a transition support 1 is placed on floor 2, and by an appropriate adhesive. A second support 1' is adhered to support 1, but located on tapered section 22 of support 1, where it is glued in place. The thin end 18' of support 1' is located further from floor 4 than thin end 18 of support 1. The upper part 30, shown in dotted lines, is severed from support 1'. This can be accomplished by using a blade, cutting part way into support 1' at line 32, and then bending and severing part 30 from support 1'. The final product is shown in perspective in FIG. 6, with the ridges omitted for the sake of clarity.

Transition support 1 s preferably made from vinyl (such as molded vinyl and extruded vinyl) or rubber composite so that it will have the desired flexibility and resilience. Harder materials may work in some situations, including polyethylene, polyester, recycled plastic, vinyl mixed with fillers such as limestone, vinyl composition and plastic-like materials.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A transition support for extending over a low area of a floor and for extending under a flooring material where the floor has a high area at a relatively high height adjacent to the low area at a relatively low height, with a juncture between the high area and the low area, and a difference in the heights between the high area and the low area of the floor, said transition support comprising:

an elongate wedge in sheet form, said wedge including:

a relatively thick end having a top edge and a bottom edge, and a thickness between the top edge and the bottom edge, the thickness being generally equal to said difference in the heights between the high area of the floor and the low area of the floor, said thick end being placeable at the juncture adjacent the high area of the floor;

a relatively thin end disposed opposite said thick end and being parallel to said thick end, said thin end being placeable on the low area of the floor remote from the high area of the floor and the juncture;

a generally flat bottom surface extending between said thin end and the bottom edge of said thick end; and a generally flat tapering upper surface extending between said thin end and the top edge of said thick end, said tapering upper surface defining a support surface means for being covered with the flooring material, the distance between said thick end and said thin end being at least 30 times the thickness of said thick end, said wedge being means for rendering the junction generally unnoticeable to persons walking across the flooring material on said tapering upper surface and for generally preventing the jostling of wheeled vehicles crossing the flooring material on said tapering upper surface.

2. A transition support according to claim 1 wherein the thickness of said thick end is at least 3/16 inches and the distance between said thick end and said thin end is at least 12 inches.

3. A transition support according to claim 1 wherein said support is selected from the group consisting of vinyl, polyester, recycled plastic, vinyl mixed with filler, vinyl composition and plastic-like material.

4. A transition support according to claim 1 wherein said support is selected from the group consisting of molded vinyl and extruded vinyl.

5. A transition support according to claim 1 wherein said tapering upper surface interconnects said thick end and said thin end at an interior angle of less than 10° measured at said thin end.

6. A transition support according to claim 5 wherein said interior angle is less then 5°.

7. A transition support according to claim 5 wherein said interior angle is 3°.

8. A transition support according to claim 1 wherein said tapering upper surface has physical characteristics for retaining adhesives thereon.

9. A transition support for extending over the low area of a floor and for extending under flooring material where the floor has a high area at a relatively high height adjacent to the low area at a relatively low height, with a juncture between the high area and the low area, and a difference in the heights between the high area and the low area of the floor, said transition support comprising:

an elongate wedge in sheet form, said elongate wedge including:

a relatively thick end, said thick end being severable to render a final thickness of a final thick end being generally equal to a desired height for being placeable at the juncture adjacent the high area of the floor, said final thickness having a top edge and a bottom edge, with the upper surface of the flooring material on said transition support being flush with the high area;

a relatively thin end disposed opposite said final thick end and parallel to said final thick end, said thin end being placeable on the low area of the floor remote from the high area of the floor and the juncture;

a generally flat bottom surface extending between said thin end and the bottom edge of said thick end; and a generally flat tapering upper surface extending between said thin end and the top edge of said thick end, said tapering upper surface defining support surface means for being covered with the flooring material, the distance between said final thick end and said thin end being at least 30 times the thickness of said final thick end, said elongate wedge being means for rendering the junction generally unnoticeable to persons walking across the flooring material on said tapering upper surface and for generally preventing the jostling of wheeled vehicles crossing the flooring material on said tapering upper surface.

10. A transition support for extending over a low area of a floor and for extending under a flooring material where the floor has a high area at a relatively high height adjacent to the low area at a relatively low height, with a juncture between the high area and the low area, and a difference in the heights between the high area and the low area of the floor, said transition support comprising:

an elongate wedge in sheet form, said elongate wedge including:

a relatively thick end having a top edge and a bottom edge, and a thickness between the top edge and the bottom edge, the thickness being generally equal to said difference in the height between the high area of the floor and the low area of the floor and the thickness of the flooring material, said thick end being placeable at the juncture adjacent the high area of the floor;

a relatively thin end disposed opposite said thick end and parallel to said thick end, said thin end being placeable on the low area of the floor remote from the high area of the floor and the juncture;

a generally flat bottom surface extending between said thin end and the bottom edge of said thick end; and a generally flat tapering surface extending between said thin end and the top edge of said thick end, said tapering surface defining a support surface means for being covered with the flooring material, the distance between said thick end and said thin end being at least 30 times the thickness of said thick end, said elongate wedge being means for rendering the junction generally unnoticeable to persons walking across said tapering upper surface and for generally preventing the jostling of wheeled vehicles crossing the flooring material on said tapering upper surface.

11. A transition support according to claim 10 wherein the thickness of said thick end is at least 3/16 inches and the distance between said thick end and said thin end is at least 12 inches.

12. A transition support according to claim 10 wherein said support is selected from the group consisting of vinyl, polyester, recycled plastic, vinyl mixed with filler and vinyl composition.

13. A transition support according to claim 10 wherein said support is selected from the group consisting of molded vinyl and extruded vinyl.

14. A transition support according to claim 10 wherein said tapering upper surface interconnects said thick end and said thin end at an interior angle of less than 10° measured at said thin end.

15. A transition support according to claim 14 wherein said interior angle is less than 5°.

16. A transition support according to claim 14 wherein said interior angle is 3°.

17. A transition support according to claim 10 wherein said tapering upper surface has physical characteristics for retaining adhesives thereon for adhesively securing said support to the flooring material.

18. A transition support for extending over a low area of a floor and for extending under a flooring material having an upper surface where the floor has a high area at a relatively high height adjacent to the low area at a relatively low height, with a juncture between the high area and the low area, and a difference in the heights between the high area and the low area of the floor, said transition support comprising:

an elongate wedge in sheet form, said wedge including:

a relatively thick end having a top edge and a bottom edge, and a thickness between the top edge and the bottom edge, the thickness being generally equal to a desired height relative to the height of the high area of the floor for being placeable at the juncture adjacent the high area of the floor with the upper surface of the flooring material on said transition support being generally flush with the high area of the floor;

a relatively thin end disposed opposite said thick end and being parallel to said thick end, said thin end being placeable on the low area of the floor remote from the high area of the floor and the juncture; and a generally flat bottom surface extending between said thin end and said thick end; and a generally flat tapering surface extending between said thin end and the top edge of said thick end, said tapering upper surface defining support surface means for being covered with the flooring material, the distance between said thick end and said thin end being at least 30 times the thickness of said thick end, said elongate wedge being means for rendering the junction generally unnoticeable to persons walking across the flooring material on said tapering upper surface and for generally preventing the jostling of wheeled vehicles crossing the flooring material on said tapering upper surface.

* * * * *